US006817031B1

(12) United States Patent
Gravlin

(10) Patent No.: US 6,817,031 B1
(45) Date of Patent: Nov. 16, 2004

(54) SUMMERWEAR GARMENT CONVERTIBLE TO A POUCH

(76) Inventor: Luisa V. Gravlin, 7620 Tarpley Dr., Derwood, MD (US) 20855

( * ) Notice: Subject to any disclaimer, the term of this patent is extended or adjusted under 35 U.S.C. 154(b) by 0 days.

(21) Appl. No.: 10/670,956

(22) Filed: Sep. 26, 2003

(51) Int. Cl.[7] ..... A41D 15/00
(52) U.S. Cl. ..... 2/67; 2/250
(58) Field of Search ..... 2/67, 69, 238, 2/228, 71, 72, 86, 89, 94, 113, 115, 244, 247, 249, 250–252, 301; 450/3, 11, 30, 86

(56) References Cited

U.S. PATENT DOCUMENTS

| | | | | | |
|---|---|---|---|---|---|
| 1,999,010 | A | * | 4/1935 | Tait | 450/30 |
| 2,072,030 | A | * | 2/1937 | Wilbur | 2/87 |
| 2,341,596 | A | * | 2/1944 | Cobb | 2/67 |
| 2,544,840 | A | * | 3/1951 | Kowatsch | 2/67 |
| 3,306,299 | A | * | 2/1967 | Paramore | 450/81 |
| 3,704,469 | A | * | 12/1972 | Levy | 2/67 |
| 3,797,043 | A | * | 3/1974 | Brument | 2/69.5 |
| 3,818,158 | A | * | 6/1974 | Nakanishi | 2/48 |
| 3,939,845 | A | * | 2/1976 | Guidoni | 450/68 |
| 4,031,900 | A | * | 6/1977 | Guidoni | 450/69 |
| 4,055,853 | A | * | 11/1977 | Argento et al. | 2/93 |
| 4,103,377 | A | | 8/1978 | Mayer et al. | |
| 4,106,125 | A | | 8/1978 | Palumbo | |
| 4,145,762 | A | * | 3/1979 | Wallach | 2/67 |
| 4,214,383 | A | * | 7/1980 | Allen | 36/1 |
| 4,294,257 | A | * | 10/1981 | Rennhofer | 450/71 |
| 4,301,545 | A | * | 11/1981 | Camarena | 2/67 |
| 4,347,629 | A | | 9/1982 | Itoi | |
| 4,404,689 | A | * | 9/1983 | DeWan | 2/247 |
| 4,570,266 | A | * | 2/1986 | Schlosser | 2/69 |
| 4,815,145 | A | * | 3/1989 | Chow | 2/67 |
| 4,944,042 | A | * | 7/1990 | DeWan | 2/94 |
| 5,165,111 | A | | 11/1992 | Lieberman | |
| 5,459,875 | A | * | 10/1995 | Fattorusso et al. | 2/67 |
| 5,561,865 | A | * | 10/1996 | Fjelstul | 2/227 |
| 5,564,125 | A | * | 10/1996 | Waldman et al. | 2/93 |
| 5,592,691 | A | * | 1/1997 | Ronald | 2/69 |
| 5,664,257 | A | * | 9/1997 | Hall | 2/69 |
| 5,774,892 | A | | 7/1998 | Tisdale et al. | |
| 5,815,833 | A | | 10/1998 | Kuo | |
| 5,860,164 | A | | 1/1999 | Johnson | |
| 5,991,920 | A | * | 11/1999 | Holland | 2/67 |
| 5,996,121 | A | * | 12/1999 | Harris | 2/69 |
| 6,185,741 | B1 | * | 2/2001 | Kehoe | 2/67 |
| 6,205,585 | B1 | * | 3/2001 | Capparelli | 2/106 |
| 6,275,993 | B1 | * | 8/2001 | McCarley | 2/84 |
| 6,336,226 | B1 | * | 1/2002 | Garcia | 2/227 |
| 6,405,377 | B1 | | 6/2002 | Davis | |
| 2002/0088047 | A1 | | 7/2002 | Greenblatt | |
| 2004/0000001 | A1 | * | 1/2004 | Holland | 2/67 |

FOREIGN PATENT DOCUMENTS

| | | |
|---|---|---|
| EP | 1 149 539 A1 | 10/2001 |
| FR | 2 589 334 | 5/1987 |
| FR | 2 819 384 | 7/2002 |

OTHER PUBLICATIONS

Gershman, Maurice. "Self–Adhering Nylon Tapes"Journal of the American Medical Association, vol. 168, No. 7, p. 930, Oct. 1958.*

* cited by examiner

*Primary Examiner*—John J. Calvert
*Assistant Examiner*—Alissa L. Hoey
(74) *Attorney, Agent, or Firm*—Richard C. Litman

(57) ABSTRACT

The summerwear garment convertible into a pouch has an upper torso garment and a lower torso garment. The lower torso garment has two-pockets. The upper torso garment is folded and placed into one of the two pockets for storage. The two pockets each have an open top side and three edges that are fixed to the side of the lower torso garment. Each pocket has corresponding zipper stringers bordering the three fixed side edges. When the zipper halves are mated, the three edges join together to form a pouch, the lower torso garment being folded between the pockets. The lower torso garment may be shorts or a mini-skirt, and the upper torso garment may be a cropped tank top or a halter top.

17 Claims, 13 Drawing Sheets

SUMMERWEAR GARMENT CONVERTIBLE TO A POUCH

BACKGROUND OF THE INVENTION

1. Field of the Invention

The present invention relates to convertible garments, more particularly to an upper torso garment and lower torso garment that can be folded and converted into a self-contained pouch in order to be easy to use, carry and travel with.

2. Description of the Related Art

People who are enjoying the sun and the water usually are doing so on vacation or after having planned an outing at the beach or by the pool. In these situations, swimwear is the appropriate article of clothing to wear and, at times, it is the most amount of clothing worn. However, when off the beach, social mores, public rules and convention require people to cover up in public. For example, many restaurants require patrons to be clothed before entering their establishment. These minor distractions from the main purpose of the trip, which is to be in the sun or the water, require one to find garments to put on and cover up the body.

Covering up should be effortless and as easy as possible, in order to make the transition from on-beach to off-beach attire quick. However, most outer garments are bulky, and it is an inconvenience to carry them to the beach. It is often an annoyance to have to go back to one's hotel or motel room to change into outer garments. The transition is further made difficult by cover up apparel that absorb water and sun tan lotion.

Many women and young girls like to wear bikinis or two piece bathing suits at the beach or pool. In recent years, thong bikinis have become popular. While fashionable at the beach, such outfits are inappropriate for wear on the public streets. Some modest form of lightweight outer garment, such as a pair of shorts or a mini-skirt with a matching top, which can be folded into a small pouch not much larger than the palm of the hand for storage and transport, would be desirable. It is further desirable that the garment be fashionable, and appropriate for summerwear or activewear.

Further, in order to maximize space during travel, articles of clothing that are multifunctional or that can be easily folded and carried are desirable. Convertible garments have been developed which convert clothing for the lower body to clothing for the upper body, to convert long garments into shorter garments, to convert pants to skirts and even jackets into bags.

French Patent Number 2,589,334, published on May 7, 1987, describes a jacket that is convertible into a bag. The jacket is converted into a purse by two pockets that are zippered on all four edges. The purse provides a zippered pocket on the purse's external panel and it has a strap to hold the purse across the wearer's body. French Patent Number 2,819,384 published on Jul. 19, 2002, describes a convertible first garment having a pouch to hold a second outwear garment that can be worn over the first garment.

A number of convertible articles of clothing have been developed that allow the article to be used for more than one purpose. U.S. Patent Publication Number 2002/0088047, published on Jul. 11, 2002, describes a convertible article of clothing that can be worn either on the upper body or the lower body. U.S. Pat. No. 4,106,125, issued to Palumbo on Aug. 15, 1978 describes a skirt or dress that can be converted into shorts or pants, and vice versa, by joining front and rear panels at the crotch region.

U.S. Pat. No. 5,774,892, issued to Tisdale et al. on Jul. 7, 1998, describes convertible clothing that uses zippers to transform pants and long-sleeved shirts into shorts and short-sleeve shirts, respectively. European Patent Number EP 1,149,539, published on Oct. 31, 2001, describes a trouser that is convertible into a skirt by selectively fastening vertical edges of the leg sleeves.

Jackets that convert into other articles are disclosed in U.S. Pat. No. 4,103,377, issued to Mayer et al. on Aug. 1, 1978 (parka that doubles as a sleeping bag); U.S. Pat. No. 5,815,833, issued to Kuo on Oct. 6, 1998 (three in one article that converts to a sleeping bag, a jacket and a carrying bag); U.S. Pat. No. 4,347,629, issued to Itoi on Sep. 7, 1982 (jacket that can be converted into a bag); U.S. Pat. No. 5,165,111, issued to Lieberman on Nov. 24, 1992 (jacket integrated into a back pack and used in conjunction with the backpack while it is worn); U.S. Pat. No. 5,860,164, issued to Johnson on Jan. 19, 1999 (multi-purpose garment convertible into a tote-bag or back-pack); U.S. Pat. No. 6,405,377, issued to Davis on Jun. 18, 2002 (jacket convertible into a tote-bag or back-pack).

None of the above inventions and patents, taken either singly or in combination, is seen to describe the instant invention as claimed. Thus a summerwear garment convertible into a pouch solving the aforementioned problems is desired.

SUMMARY OF THE INVENTION

The summerwear garment convertible into a pouch is a pair of shorts or a mini-skirt which is convertible into a pouch, together with a matching top which can be folded and stored in a pocket on the shorts or skirt in order to be easy to use, carry and travel with. The shorts or skirt has a pair of matching pockets on opposite sides. The two pockets each have an open top side and three edges that are fixed to the sides of the lower torso garment. Each pocket has corresponding zipper stringers bordering the three fixed side edges. When the zipper stringers are mated, the three edges of both pockets abut the other to form a pouch containing the folded lower torso garment and the upper torso garment. Women would use the lower torso garment and the upper torso garment combination; if desired, men could use the lower torso garment alone, or also in combination with a top.

Accordingly, it is a principal object of the invention to provide a summerwear garment convertible into a pouch that is small and easy to carry and travel with.

It is another object of the invention to provide a summerwear garment convertible into a pouch that is thin and flexible enough to be folded into a pouch to take up very little space so it can be easy to carry and travel with.

It is a further object of the invention to provide a summerwear garment convertible into a pouch that is quick-drying and wrinkle-free.

Still another object of the invention is to provide a summerwear garment convertible into a pouch that is fashionable and easy to use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
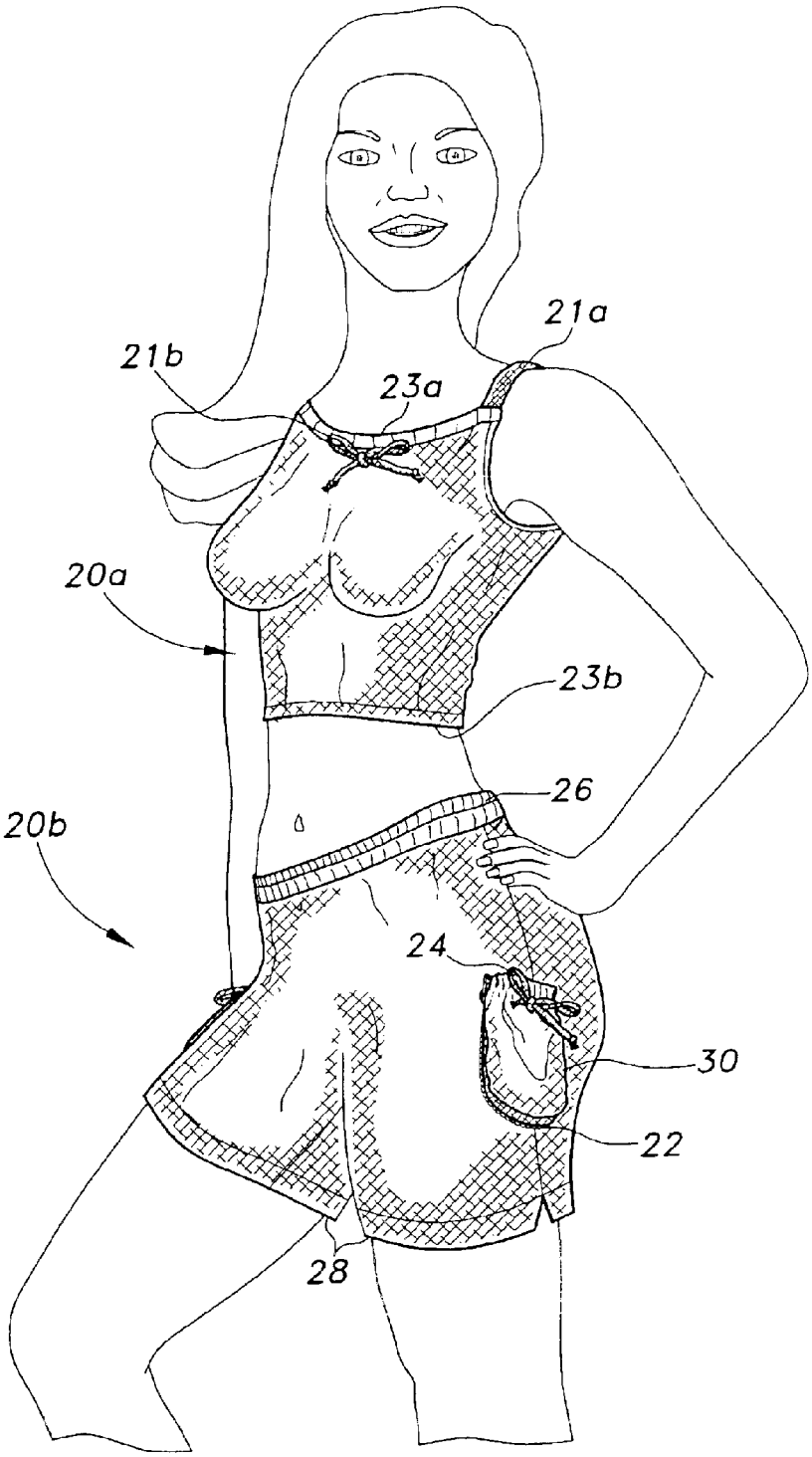
FIG. 1 is an environmental, perspective view of a summerwear garment convertible into a pouch according to the present invention, shown with the garment being worn.

The present invention is a summerwear garment convertible into a pouch, designated generally as 20 in the drawings, as shown in FIGS. 1–9. The summerwear 20 has lower torso garment 20*b* to cover the lower portion of the torso and an upper torso garment 20*a* to cover the chest. In the preferred embodiment the upper torso garment is a tank top 20*a* with the midriff cropped off, and the lower torso garment is a pair of shorts 20*b*. The shorts 20*b* and tank top 20*a* can be styled for wear by women, or for wear by men. If desired, men can wear the shorts 20*b* without the tank top 20*a*.

As seen in FIG. 1, an elastic waistband 26 is sewn into a seam at the top of the shorts 20*b* to encircle the waist and retain the shorts 20*b* on the wearer's body, while two legs 28 extend from the shorts 20*b*, defining leg openings at the bottom end of the shorts 20*b*. The shorts 20*b* are preferably short shorts, with the legs terminating at the top of the thigh. The shorts 20*b* are preferably short-shorts, with the legs terminating at the top of the thigh. A pocket 30 is located on the left side and right side of the shorts 20*b*, at each leg 28, just at or just below the hips. Zipper fastener 22 borders three consecutive fixed edges of the pockets 30. Zipper fastener 22 may be made from metal, or from plastic. A tie fastener 24 is disposed on the open top side of each pocket 30, at about half an inch from its top. The tie 24 releasably constricts the opening of the pocket.

The shorts 20*b* may be formed in a variety of ways, for example, the shorts 20*b* may be formed by a left panel and a right panel joined by front and rear seams and by inseams along the left and right leg sleeves 28. Alternatively, the left and right panels may be further formed by front and rear portions joined by side seams, so that the lower torso garment comprises left front, left rear, right front, and right rear panels. Still further, instead of left and right panels, in some embodiments the shorts 20*b* may be formed solely by front and back panels joined by side seams.

The tank top 20*a* has a neck opening 23*a* and shoulder straps 21*a*. The shoulder straps 21*a* are preferably of the type known as "finger" straps or "spaghetti" straps, and may be formed by a single cord that is looped through seams disposed on front and back panels of the tank top 20*a*, exiting at the ends of the front and back panels to form the shoulder straps 21*a*, and having opposite ends of the cord exit the seams at the front of the neck opening 23*a*. This allows the cord forming the shoulder straps to be loosened or tightened as required to adjust for chest size. The ends of the cord may be formed into a bow for decorative effect.

The midriff of the tank top 20*a* is cropped off, so that the torso opening 23*b* encircles the upper torso and ends just below the bust line for females, or just below the pectorals for men, exposing the "abs" (abdominal muscles). The cord forming the shoulder straps 21 has two free ends 21*b*. One end 21*b* of the cord is inserted through a small opening on the center front seam of the neck opening to be threaded through one side of the front seam to the back seam, and returns to be threaded to the other side of the front seam of the neck opening 23*a*. The shoulder straps 21*a* are adjustable by either pulling the free ends 21*b* out of the seams to reduce the amount of strap 21*a* exposed on the shoulder or by lengthening the shoulder strap 21*a* and reducing the length of the free ends 21*b* exposed. By adjusting the amount of strap 21*a* used over the shoulders, the wearer is able to determine where the waist opening 23*b* will stop on the midriff and how much of the midriff region will be exposed. Once the appropriate shoulder strap 21*a* length is reached, the wearer ties the free ends of the strap 21*b* on the front panel of the neck opening 23*a* to form a bow.

Figure 2:
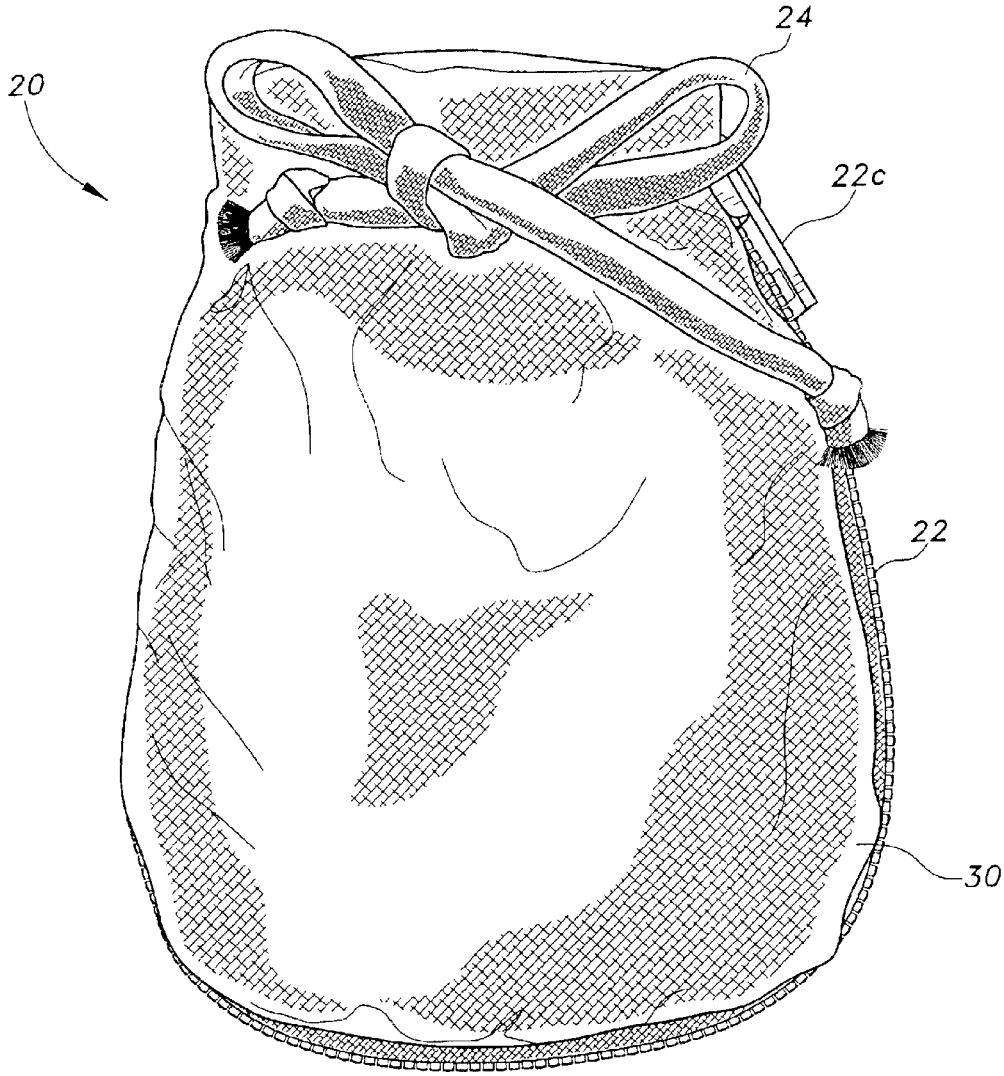
FIG. 2 is a front view of the summerwear garment convertible into a pouch according to the present invention configured as a pouch for storage or transport.

FIG. 2 shows one side of the summerwear garment 20 of the present invention configured to form a pouch. The pouch is formed by the two rectangular pockets 30, each pocket 30 comprising one side of the pouch, and corresponding zipper fastener 22 bordering the three consecutive fixed side edges of each pocket 30. When the zipper stringers are mated, the three consecutive fixed side edges of both pockets 30 are fastened to each other to form the pouch 20 containing the folded shorts 20*b* and the cropped tank top 20*a*. The tie fastener 24 is disposed along the fourth open top side of each pocket 30. In the closed pouch configuration, the tie 24 can be used as handles to easily carry the pouch on the wrist or by the fingers. The pouch is dimensioned only slightly larger than the palm of the hand, so that the summerwear garment 20 is conveniently stored or transported. Representative dimensions of the pouch are between four and five inches long, between three and four inches wide, and between two and two and one-half inches thick, although the present invention need not necessarily be limited by the dimensions recited.

Figure 3:
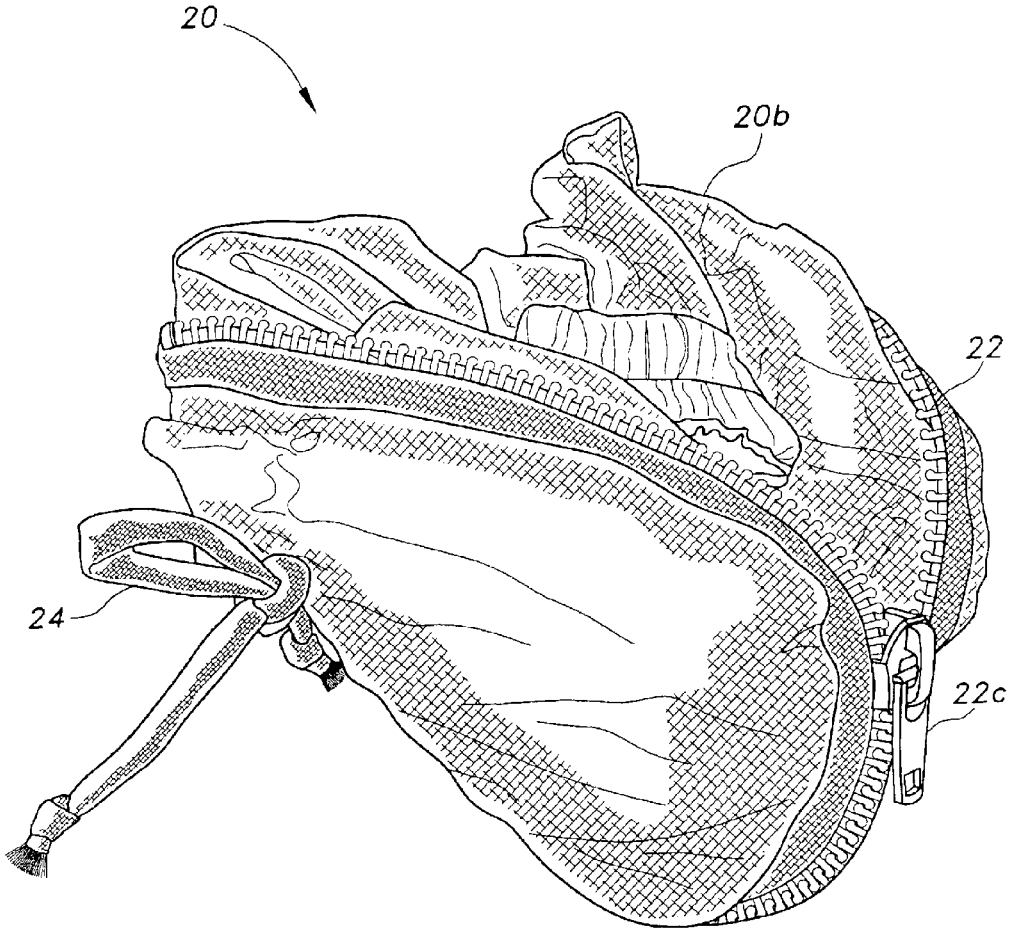
FIG. 3 is a side perspective view of the summerwear garment convertible into a pouch according to the present invention with the zipper being pulled partially down to show the shorts folded between the pockets.
Figure 4:
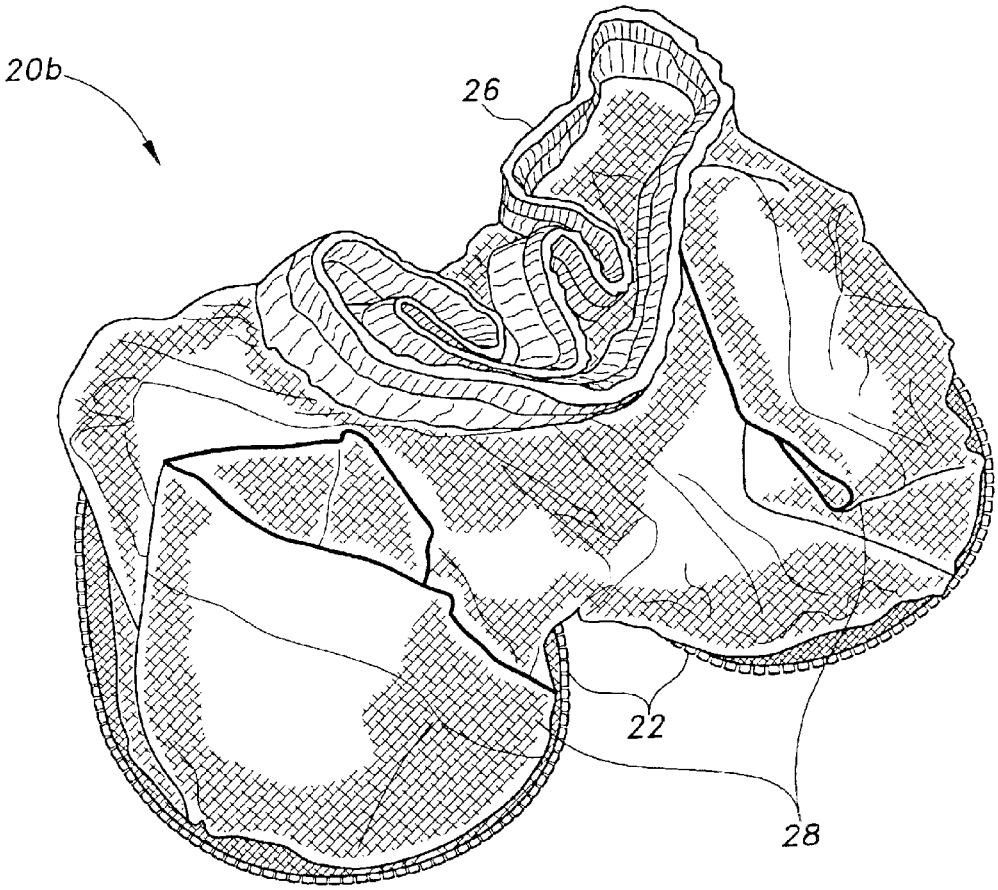
FIG. 4 is a side perspective view of the summerwear garment convertible into a pouch according to the present invention with the zipper slider having been pulled all the way around the stringers to the opposite side to show folding of the waist and legs into the interior of the pouch.
Figure 5:
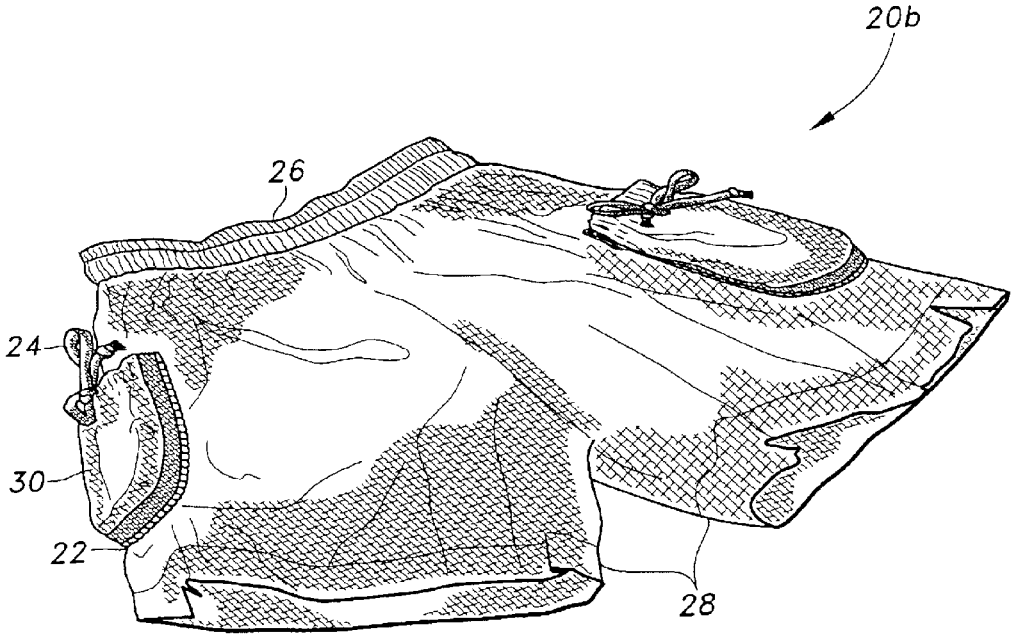
FIG. 5 is a perspective view of the shorts of the summerwear garment convertible into a pouch according to the present invention.

FIG. 3 shows the zipper fastener 22 partially unzipped along one side of the pouch, revealing the shorts 20*b* stored inside the pouch 20. The zipper 22 is operated in conventional manner, by pulling zipper tab 22*c* to move the slider. FIG. 4 shows the zipper tracks 22 more than two-thirds separated, to expose the shorts 20*b*. The pouch is shown in an open configuration where legs 28 and waistband 26 are displayed folded between pockets 30. When the shorts 20*b* are fully unfolded, the pockets 30 are disposed on the left and right sides of the garment, as seen in FIG. 5. Three consecutive side edges of each pocket 30 are sewn to the sides of the shorts leaving the top side of each pocket 30 open. The open top side of each pocket 30 has a seam through which the tie 24 is disposed. The tie 24 is made of two individual straps each having two ends, a free end and a fixed end. The fixed end is sewn to a side of the pocket leaving the free end to exit a center opening found on the seam. The two free ends exit the seam at the center opening, allowing the wearer to gather the seam along the tie 24 and constrict the top side of the pocket 30. Zipper stringers 22*a* and 22*b* forming the opposing sides of zipper fastener 22 are positioned on the three consecutive fixed side edges of each pocket 30. The tank top 20*a* is concealed and stored in either pocket 30 in a folded configuration, as seen in FIG. 6.

Figure 6:
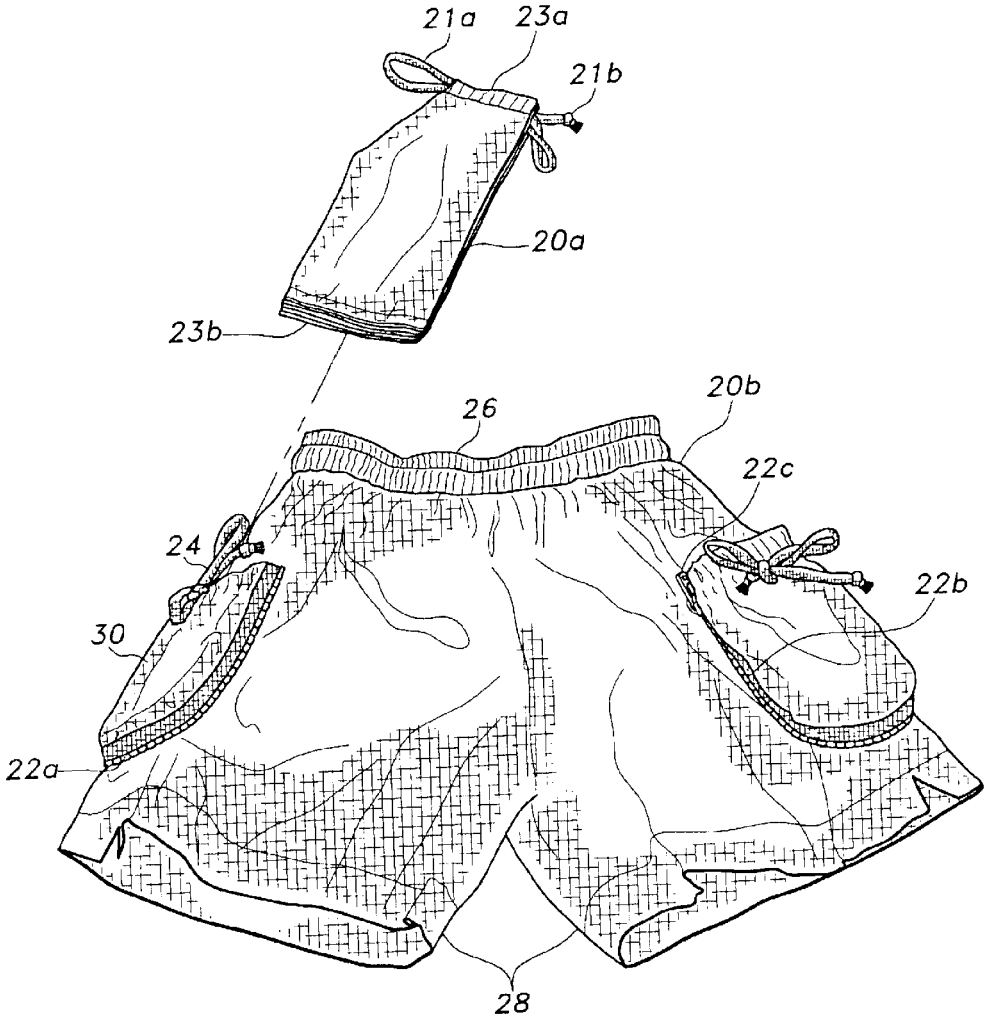
FIG. 6 is an exploded, perspective view of the summerwear garment convertible into a pouch according to the present invention, showing how the top is folded for insertion into one of the pockets.
Figure 7:
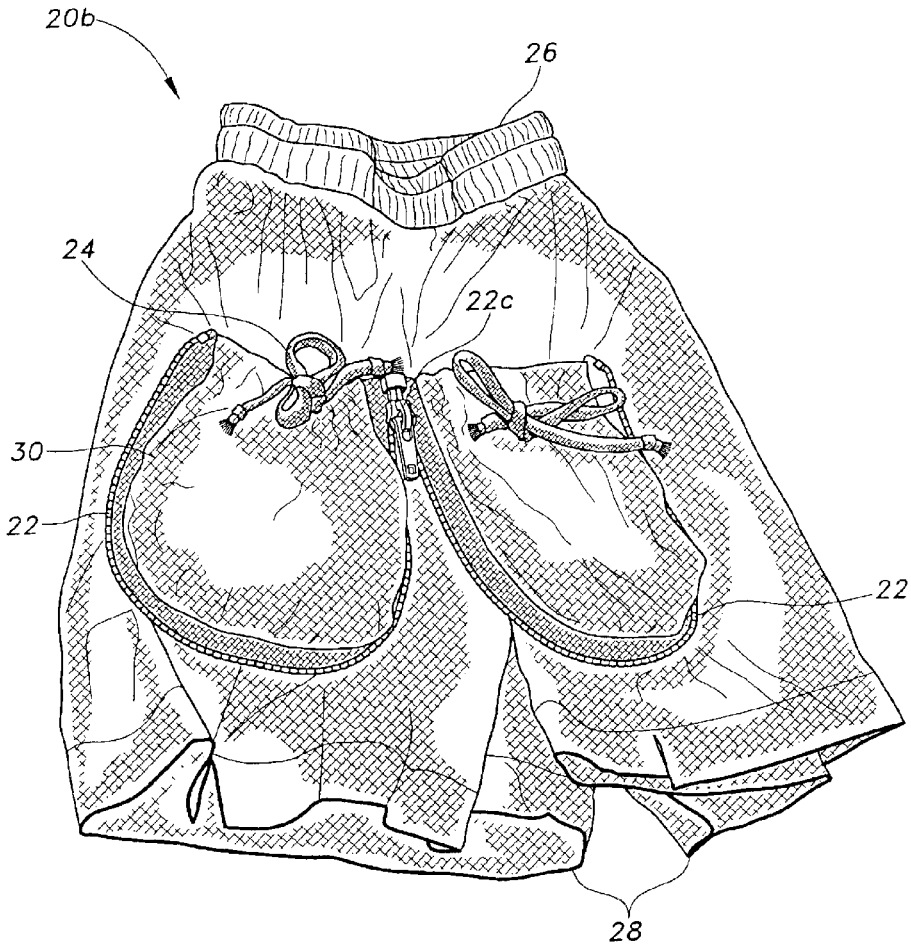
FIG. 7 is a perspective view of the summerwear garment convertible into a pouch according to the present invention with the pin on one zipper stringer inserted through the slider on the other stringer, the slider being against the stop box, in order to start formation of the pouch.
Figure 8:
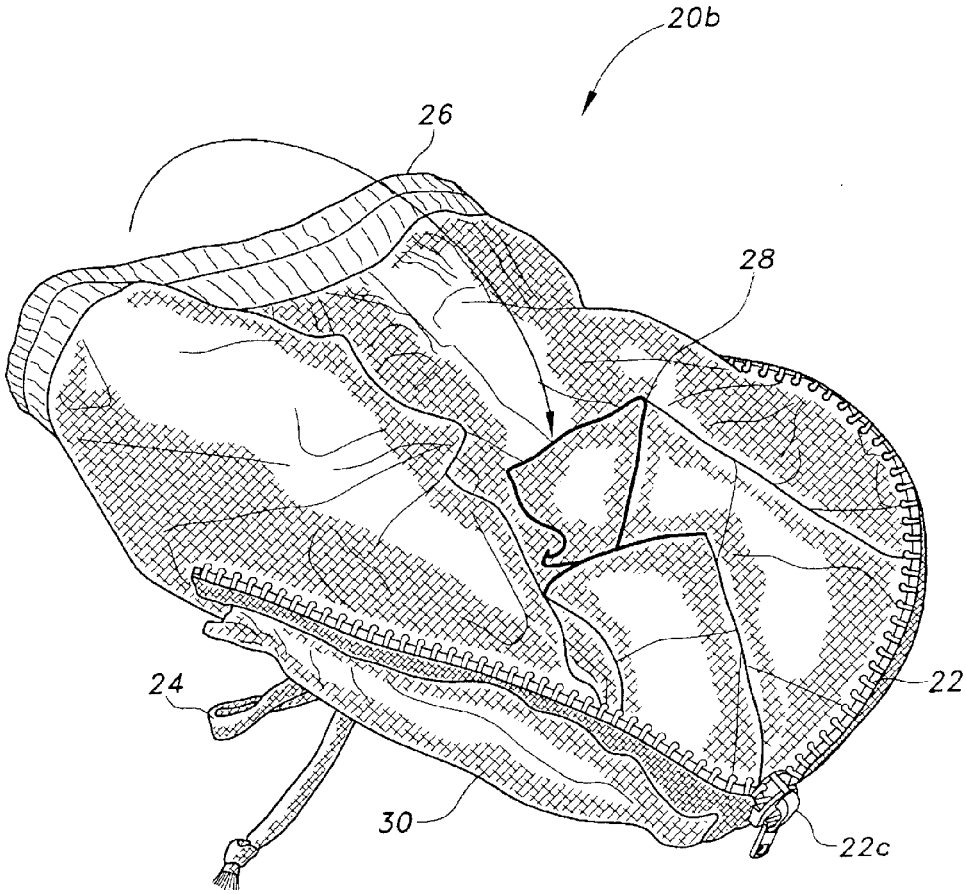
FIG. 8 is a perspective view of the summerwear according to the present invention with the zipper one-third closed and the legs being folded up against the pockets.
Figure 9:
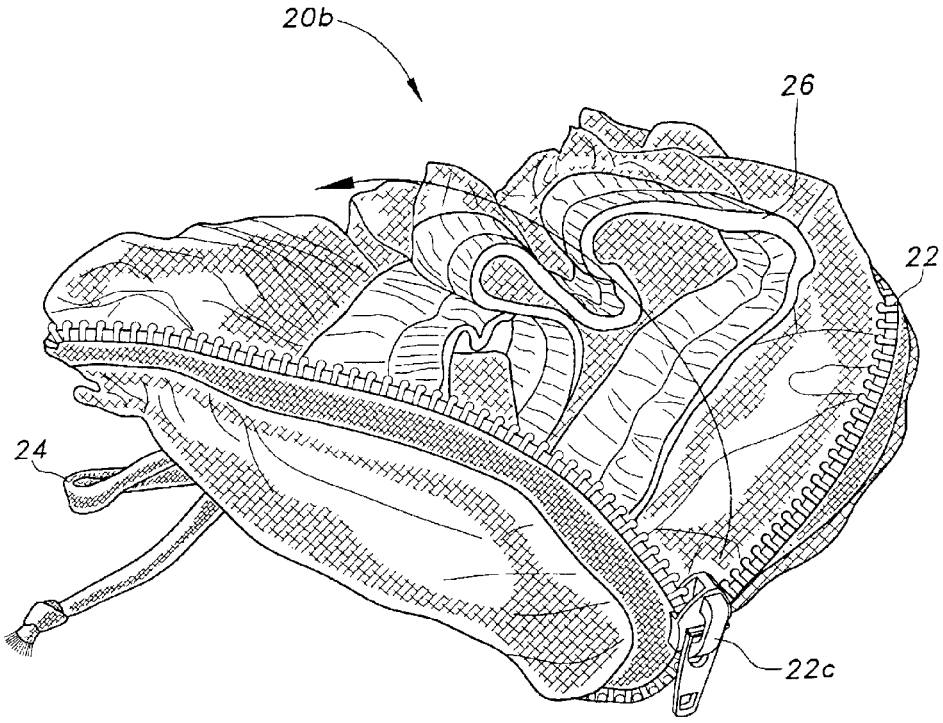
FIG. 9 is a perspective view of the summerwear according to the present invention with the zipper one-third of the way through the zipper track and the waist being folded down over the legs.

To return the summerwear 20 to its closed pouch configuration 20, top 20*a* is folded and inserted into one of the pockets, as shown in FIG. 6, and the shorts 20*b* are folded to approximate the pockets 30, with the pin of male zipper stringer 22*a* being inserted into the slider of female zipper stringer 22*b*, zipper tab 22*c* being pulled to begin mating the zipper fastener 22, as shown in FIG. 7. By mating male zipper track 22*a* to female zipper track 22*b*, the shorts 20*b* are forced into a contracted, folded arrangement, reducing the total surface area exposed. FIG. 8 shows the zipper tab 22*c* being pulled approximately one-third of the way around zipper 22. The shorts 20*b* are folded, first by pleating the sides of the shorts 20*b* into the center region, then by folding the legs 28 up to the center region, and finally by folding the waistband 26 down over the legs 28, as seen in FIG. 9, compressing the lower torso garment 20*b* on top of itself. Once the shorts 20*b* are folded, in a compact state, the user is able to easily pull zipper tab 22*c* along the zipper 22 from one end to the other.

Figure 10A:
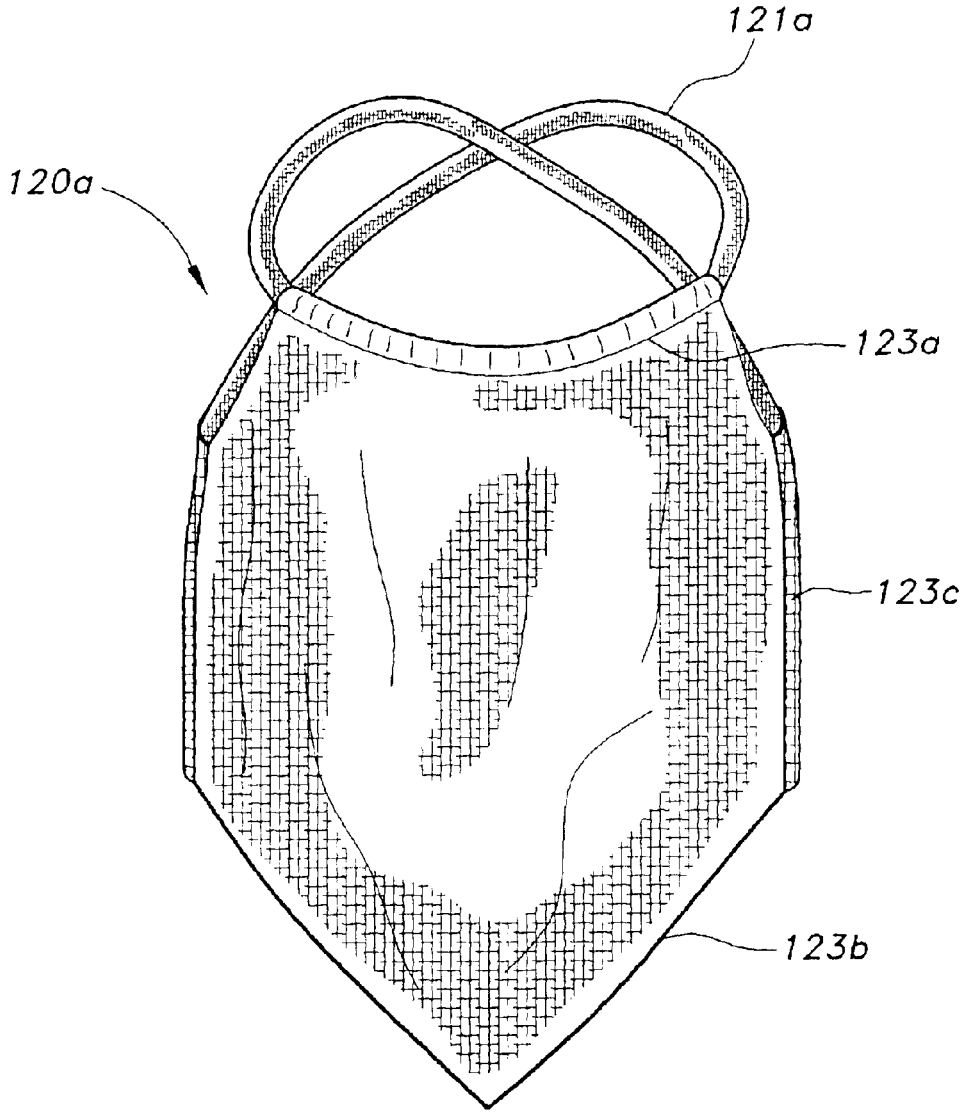
FIG. 10A is a front view of an alternative embodiment the top of the summerwear garment, showing the upper torso garment as a halter top.
Figure 10B:
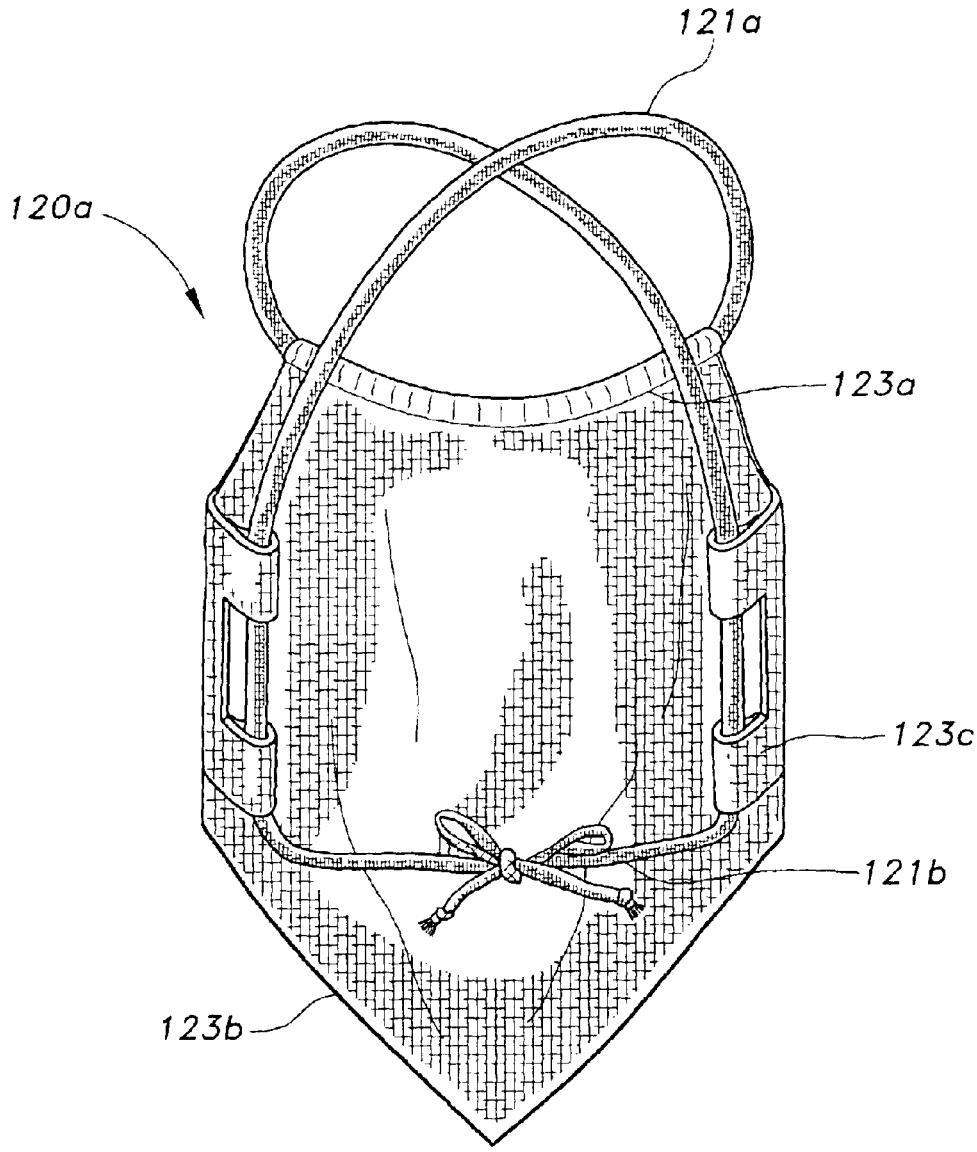
FIG. 10B is a rear view of the halter top of FIG. 10A.

In an alternative embodiment, the upper torso garment is formed as a halter top 120*a*, as seen in FIGS. 10A and 10B. The halter top 120*a* has only a front panel and a strap 121*a* having two free ends 121*b* that are used to tie the halter top 120*a* at the back. The strap 121*a* is threaded through a seam along the neck opening 123*a* and is fed through the sides 123*c* which is either constructed as seams or as loops attached to the sides 123*c* of the front panel. When the sides 123*c* are constructed as seams, each strap 121 is fed down through the seams on the sides 123*c* of the front panel and tied across the lower back. When loops are used, the strap 121*a* is passed through the loops to crisscross the back like a shoelace on a shoe.

Figure 11A:
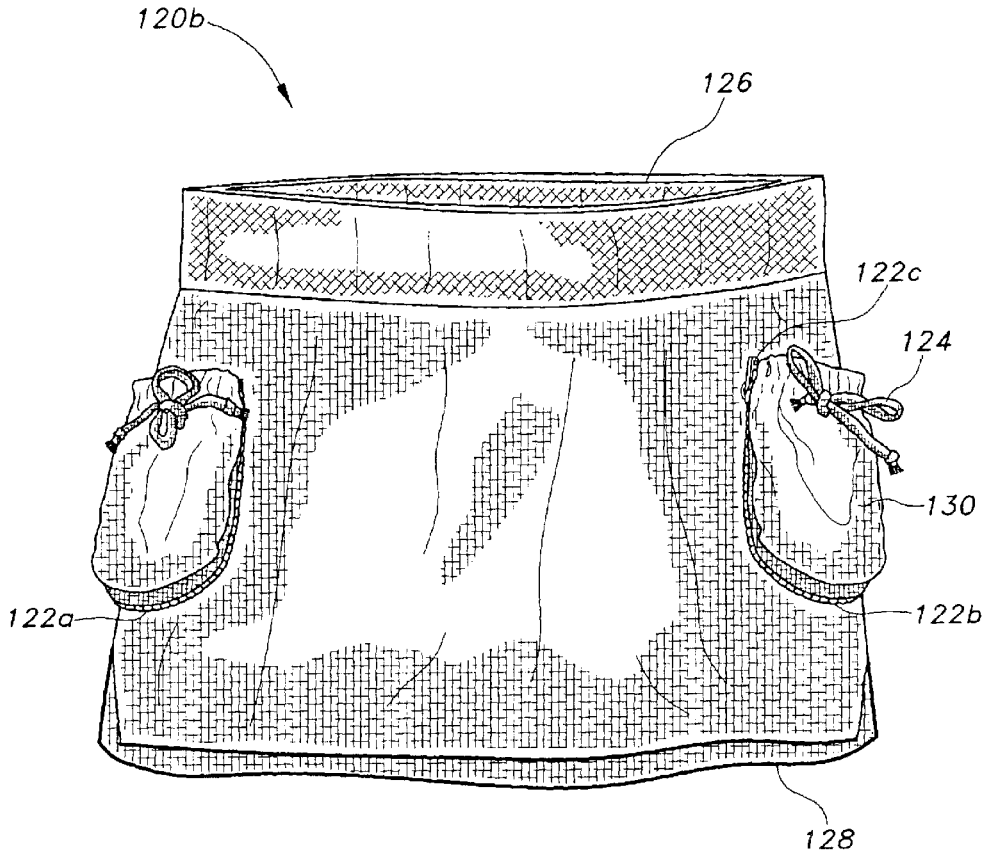
FIG. 11A is a front view of an alternative embodiment of the lower portion of the summerwear garment, showing the lower torso garment as a mini-skirt.
Figure 11B:
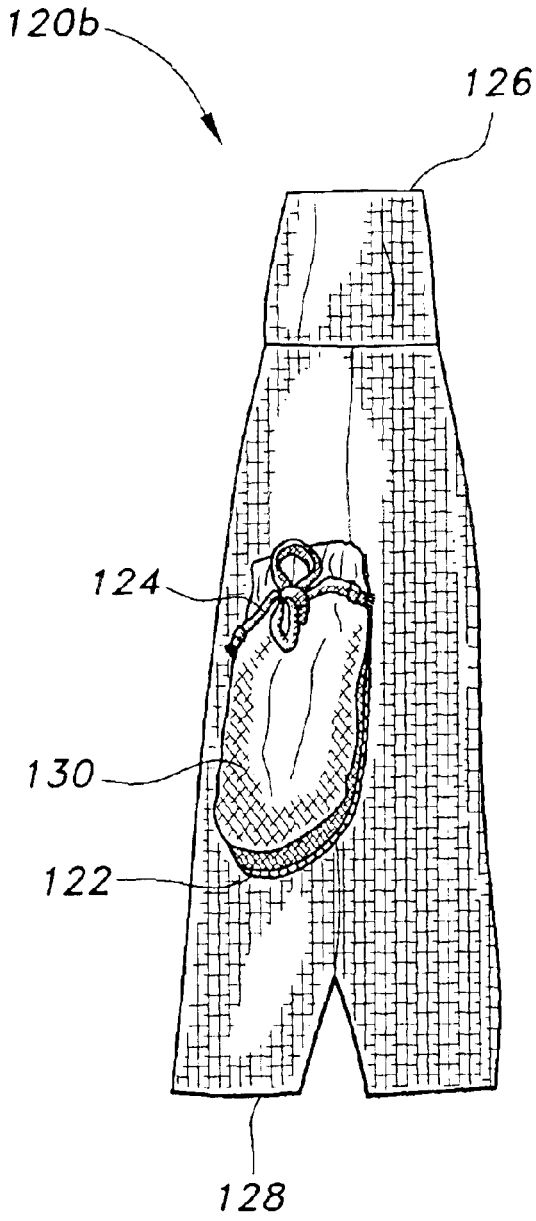
FIG. 11B is a side perspective view of the mini-skirt of FIG. 11A.

Also, instead of shorts, the lower garment may be a mini-skirt. FIGS. 11A and 11B show the mini-skirt 120*b* having a waistband 126 and a skirt 128 extending from the waistband. The mini-skirt 120*b* can be constructed by joining front and back panels at side seams, or by joining left and right panels by front and rear seams. Conversely, the mini-skirt 120*b* can be made using front right and left panels and rear right and left panels by joining center, rear and side seams, so that the garment is made of front left and right panels and rear left and right panels. The skirt may also be constructed from a single piece of fabric having a single seam in the back or along one of the sides.

The mini-skirt 120*b* has two rectangular pockets 130 positioned on its sides. Each pocket 130 has a tie 124 disposed on the open top side of each pocket 130 to constrict the opening of the pockets 130. The other three sides of each pocket 130 are sewn to the mini-skirt 120*b*. The three consecutive fixed edges of pockets 130 are trimmed with zipper stringers 122. The alternative embodiment of the summerwear is arranged into the closed pouch 120 configuration by mating male zipper track 122*a* to female zipper track 122*b*, using zipper tab 122*c*, and folding the mini-skirt 120*b* similar to the folding and tucking procedure used with the preferred embodiment.

The summerwear 20, 120 is preferably constructed using fabrics conventionally used with sports garments, such as polyester or polyamides, such as nylon; however other thin material can be used as well, such as silk or rayon. The fabric used can also be wrinkle-free and quick drying, since it is folded into a pouch and typically worn over a bathing suit. The importance of using thin material is to facilitate the folding and pleating of the garments within the pockets to allow the zippers tracks 22 and 122 to mate and close the invention into a pouch 20, 120, as well as for making the garment lightweight.

It is to be understood that the present invention is not limited to the embodiment described above, but encompasses any and all embodiments within the scope of the following claims.

I claim:

1. A summerwear garment convertible into a pouch for storage and transport, comprising:

a lower torso garment having a front, a back and opposing sides, the lower torso garment being adapted for covering a lower portion of a human torso;

a pair of rectangular pockets, each of the pockets having an open top edge, two side edges and a bottom edge with the two side edges and the bottom edge being attached to each of the sides of the lower torso garment; and mating halves of a zipper fastener continuously extending around only the two side edges and the bottom edge of said pockets, respectively;

wherein the lower torso garment when the mating halves of the zipper fastener are joined and zipped around the two side edges and the bottom edge, the lower torso garment being folded between the pockets.

2. The summerwear garment according to claim 1, further comprising an upper torso garment matching the lower torso garment, the upper garment being folded and stored in one of said pockets when not in use.

3. The summerwear garment according to claim 2, wherein said upper torso garment comprises a tank top having a midriff portion of the garment cropped off.

4. The summerwear garment according to claim 3, wherein said tank top comprises a tube having finger straps.

5. The summerwear garment according to claim 3, wherein said tank top comprises a tube having an upper edge, the upper edge having a seam defining a channel on the front and back of the garment, the front channel defining an opening at a center of the front upper edge and at opposing ends of the front and back, the tank top further comprising a cord extending through the front and back channels and extending between the openings at the sides of the front and back upper edges in order to define shoulder straps, the cord having two free ends extending from the front center opening, whereby the length of the shoulder straps is adjustable, the free ends being tied to form a decorative bow.

6. The summerwear garment according to claim 2, wherein said upper torso garment comprises a halter top.

7. The summerwear garment according to claim 2, wherein said upper torso garment comprises:

a front panel of fabric adapted for covering a chest, the front panel having an upper edge defining an upper channel and having opposing sides having guide channels formed therein; and a cord extending through the upper channel and having opposing ends crossing in back of the front panel and extending through the guide channels on the opposing sides and being tied together, thereby forming a halter top.

8. The summerwear garment according to claim 1, wherein said lower torso garment comprises a pair of short-shorts.

9. The summerwear garment according to claim 1, wherein said lower torso garment comprises a mini-skirt.

10. The summerwear garment according to claim 1, further comprising a tie fastener disposed across the open top edge of said pocket for constricting the opening formed by the top edge.

11. The summerwear garment according to claim 1, wherein the pouch measures between four and five inches long, between three and four inches wide, and between two and two and one-half inches thick.

12. The summerwear garment according to claim 1, wherein said lower torso garment is made from lightweight fabric.

13. The summerwear garment according to claim 1, wherein the mating halves of said zipper fastener comprise a first stringer having a pin attached around the two side edges and the bottom edge on one of said pockets, and a second stinger having a slider attached around the two side edges and the bottom edge of the opposing pocket, the pin being slidable into the slider in order to join the mating halves of said zipper fastener.

14. The summerwear garment according to claim 1, wherein said zipper fastener is made from metal.

15. The summerwear garment according to claim 1, wherein said zipper fastener is made from plastic.

16. The summerwear garment according to claim 1, wherein said lower torso garment is made from polyester.

17. The summerwear garment according to claim 1, wherein said lower torso garment is made from nylon.

* * * * *